US005368389A

United States Patent [19]

Dedoes

[11] Patent Number: 5,368,389

[45] Date of Patent: Nov. 29, 1994

[54] PAINT CAN COVER ASSEMBLY

[75] Inventor: John T. Dedoes, Brighton, Mich.

[73] Assignee: Dedoes Industries, Inc., Walled Lake, Mich.

[21] Appl. No.: 901,786

[22] Filed: Jun. 22, 1992

[51] Int. Cl.[5] ..... B01F 7/16

[52] U.S. Cl. ..... 366/247; 366/605; 366/184; 16/114 R; 16/DIG. 24; 220/752

[58] Field of Search ..... 366/247, 605, 281, 184; 16/DIG. 24, DIG. 41, 114 R, 114 A, 110 R, 110 A, 110.5, DIG. 18; 220/752, 755, 757, 759; 248/151, 188

[56] References Cited

U.S. PATENT DOCUMENTS

| | | | |
|---|---|---|---|
| 675,141 | 5/1901 | Scheunert | 16/114 A |
| 1,006,144 | 10/1911 | Stock | 16/114 A |
| 3,116,745 | 1/1964 | Burning | 366/281 |
| 3,236,389 | 2/1966 | Murdock | 248/188 |
| 4,364,548 | 12/1982 | Eccardt | 248/188 |
| 4,380,399 | 4/1983 | Godat et al. | 366/605 |
| 4,750,648 | 6/1988 | Krydiak | 222/484 |

FOREIGN PATENT DOCUMENTS

| | | | |
|---|---|---|---|
| 0323531 | 7/1989 | European Pat. Off. . | |
| 0273054 | 6/1927 | United Kingdom | 248/188 |

*Primary Examiner*—David A. Scherbel
*Assistant Examiner*—Tony G. Soohoo
*Attorney, Agent, or Firm*—Gifford, Groh, Sprinkle, Patmore and Anderson

[57] ABSTRACT

A cover assembly is disclosed for a paint can having an open top. The cover assembly includes a lid dimensioned to over-lie the open top of the paint can having a spout attached along one side of the lid to provide access to the contents of the paint can. A closure selectively opens and closes the spout while locking tabs detachably lock the lid across the top of the can. With the lid secured to the top of the can, a paint stir extends down into the interior of the can to continually mix the paint. The lid and spout are constructed of a material which does not react to water-based paint.

11 Claims, 2 Drawing Sheets

Fig-3
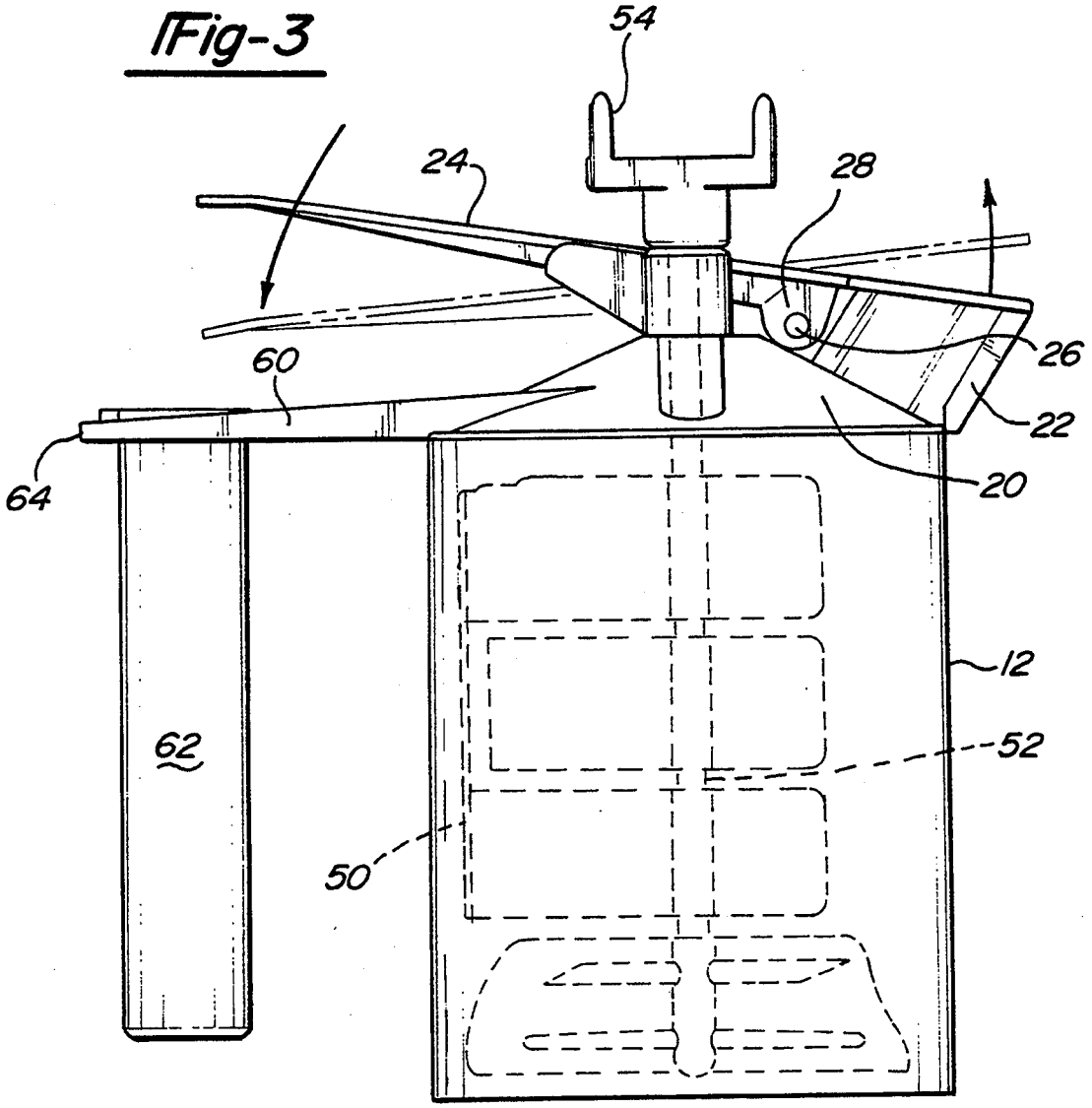
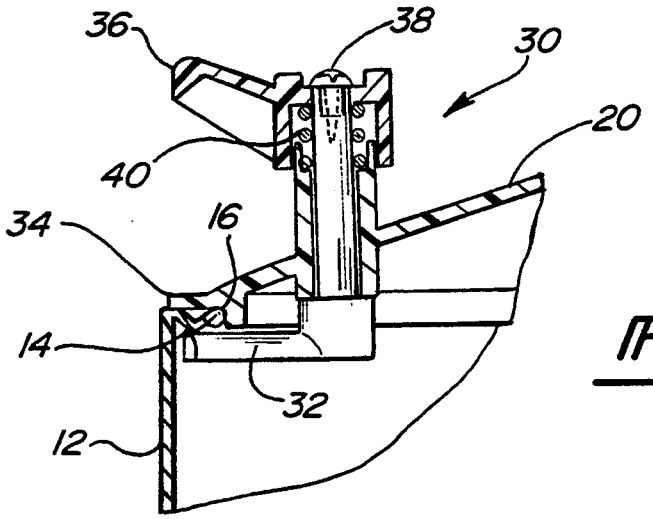
Fig-4

PAINT CAN COVER ASSEMBLY

BACKGROUND OF THE INVENTION

I. Field of the Invention

The present invention relates to a cover assembly for a paint can.

II. Description of the Prior Art

There are a number of previously known cover assemblies which are designed to over-lie the open top of a paint can Such cover assemblies include a spout with a cooperating closure which selectively opens and closes the spout. With the spout open, paint can be poured from the can.

Many of these previously known cover assemblies also include a paint stir ring assembly which extends downwardly into the interior of the can once the lid is attached to the open top of the paint can. The stirring assembly cooperates with a paint rack which engages the paint stir ring assembly to continuously stir the paint while the paint can is stored on the rack. Such paint can assemblies, together with the paint can racks are conventionally used in automotive body repair shops and the like.

These previously known cover assemblies, however, have been typically constructed of zinc for low-cost manufacture and high durability. Such previously known zinc cover assemblies have proven adequate in use for paints using hydrocarbon solvents.

In response to environmental concerns as well as governmental regulations, more and more paints now utilize water as the solvent for the paint, rather than hydrocarbons. Such water-based paints do not adversely affect the environment and particularly the ozone layer of the earth, as the paints dry.

These previously known cover assemblies, however, cannot be utilized with water-based paints since the water in paint reacts with the zinc. As such, the previously known zinc cover assemblies cannot be utilized with water-based paints.

SUMMARY OF THE PRESENT INVENTION

The present invention provides a cover assembly which overcomes the above-mentioned disadvantages of the previously known devices.

In brief, the cover assembly of the present invention comprises a lid mentioned to over-lie the open top of a paint can. A spout is attached to or formed as a part of the lid which provides access to the contents of the paint can. A closure is pivotally mounted to the top of the paint can for selectively opening and closing the spout.

In order to attach the cover assembly to the top of the paint can, a pair of locking tabs are pivotally mounted to lid. These locking tabs can be rotated by a locking lever so that the locking tabs extend under the paint can lip whereupon the paint can lip is entrapped between the locking tabs and an outer periphery above the lid.

In the preferred embodiment of the invention, a handle support extends laterally outwardly from the side of the lid opposite the spout and generally coplanar with the lid. A handle is detachably secured to the free or distal end of the handle support to facilitate handling of the paint can and cover assembly.

The lid, closure, spout and locking tabs are all constructed of a material unreactive to water-based paint Preferably the material comprises a synthetic plastic material, such as nylon, for low-cost yet durable construction.

BRIEF DESCRIPTION OF THE DRAWINGS

A better understanding of the present invention will be had upon reference to the following detailed description, when read in conjunction with the accompanying drawing, wherein like reference characters refer to like parts throughout the several views and in which:

FIG. 3 is a side view of the preferred embodiment of the present invention; and FIG. 4 is a fragmentary sectional view taken substantially along Line 4–4 in FIG. 1 and enlarged for clarity.

DETAILED DESCRIPTION OF A PREFERRED EMBODIMENT OF THE PRESENT INVENTION

Figure 1:
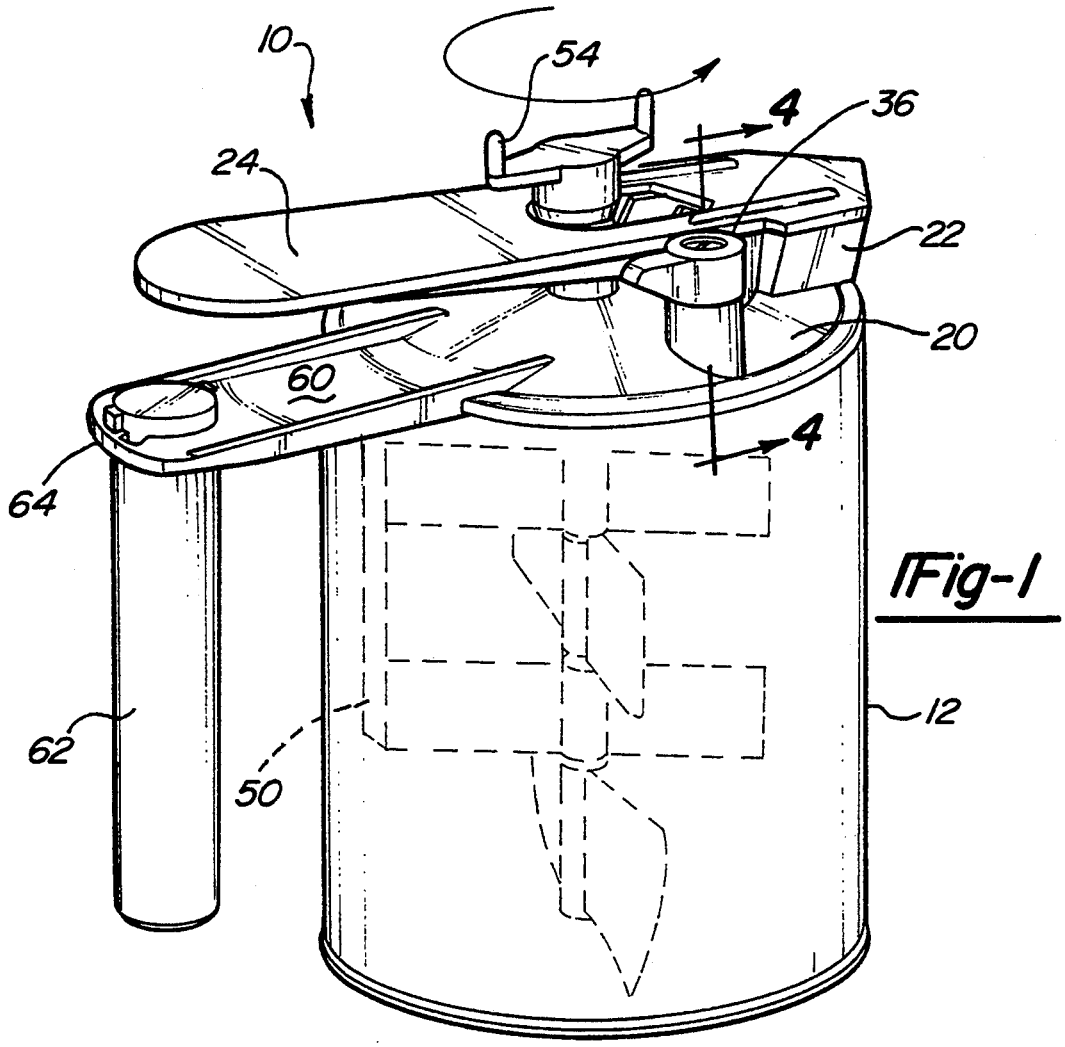
FIG. 1 is an elevational view illustrating a preferred embodiment of the present invention.

With reference first to FIG. 1 a preferred embodiment of the cover assembly 10 of the present invention is thereshown for a conventional paint can 12. As shown in FIG. 4, the paint can 12 has an inwardly protruding lip 14 around its open upper end 16.

Referring again to FIG. 1 the cover assembly 10 of the present invention comprises a generally circular lid 20 which is dimensioned to over-lie and cover the open top 16 of the paint can 12. A spout 22 is attached to or formed as a part of the lid 20 which provides access to the contents of the paint can 12 Furthermore, as best shown in FIG. 1 and FIG. 3, an elongated closure 24 is pivotally mounted to the lid 20 by pivot pins 26 so that the closure 24 is movable between a closed position, illustrated in solid line, and an open position, illustrated in phantom line in FIG. 3. In its closed position the closure 24 covers the spout 22. While in the open position, the closure 24 is spaced from the spout 22 and allows the paint to be poured from the paint can 12. A spring 28 urges the closure 24 toward its closed position.

With reference now to FIG. 1 and FIG. 4, a pair of locking assemblies 30 (only one illustrated) are mounted to diametrically opposed sides of the lid 20. Each locking assembly 30 includes a lower, locking tab 32 pivotal between a locked position illustrated in solid line in FIG. 4, and an unlocked position, illustrated in phantom line in FIG. 4. In its locked position, the locking tab 32 entraps the can lip 14 between the locking tab 32 and an outer periphery 34 of the paint can lid 20 thereby attaching the lid 20 across the open top of the can 12. Conversely, with the locking tab 32 in its unlocked position (phantom line in FIG. 4) the lid 20 can be easily removed from, or placed on the paint can 12.

Still referring to FIG. 1 and FIG. 4, a locking lever 36 is secured to an upper end of each locking tab 32 by any appropriate means, such as a fastener 38 Furthermore a helical spring 40 (FIG. 4) urges the locking lever 32 upward, as shown in FIG. 4 and thus against the paint can lip 14.

The locking levers 36 are used to rotate the locking tabs 32 between the locked and unlocked positions. Furthermore, the helical spring 40 by urging the locking tabs 32 against the paint can lip 14, ensure complete sealing between the lid 20 and the paint can 12.

With reference now especially to FIG. 3, a paint stirring assembly 50 having a shaft 52 is rotatably mounted to the lid 20 so that the shaft 52 extends axially through the center of the lid 20. A generally U-shaped driver 54 is attached to the top of the shaft 52 so that the driver 54 and shaft 52 rotate in unison with each other. The driver 54 is adapted for connection with a drive member in a conventional paint can rack of the type found in automotive repair shops and the like.

Figure 2:
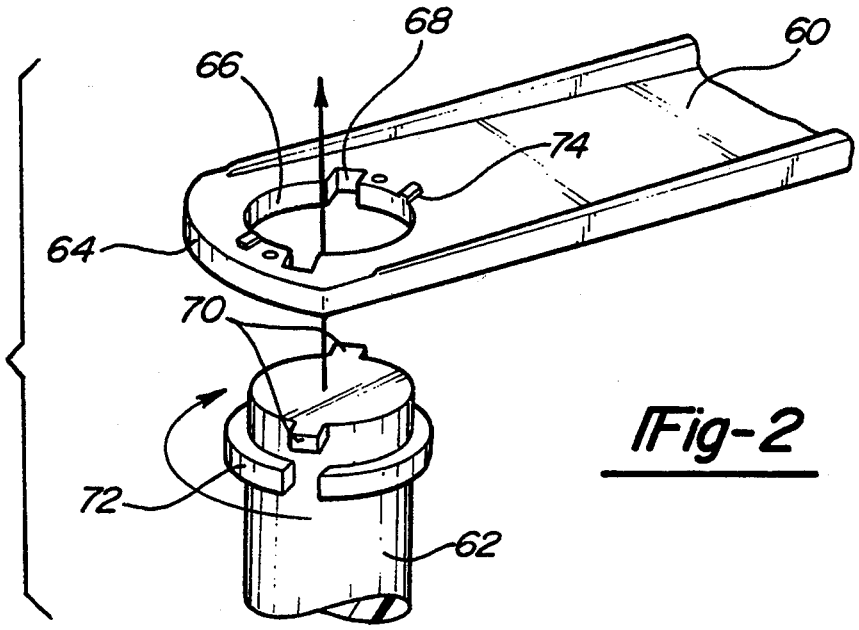
FIG. 2 is an exploded view illustrating a portion of the preferred embodiment of the present invention.

With reference now, particularly to FIG. 2 and FIG. 3, an elongated support 60 extends laterally outward from the lid 20 at a position substantially diametrically opposed from the spout 22. Additionally, as best seen in FIG. 3, the handle support 60 is substantially coplanar with the lid 20

A generally cylindrical handle 62 is detachably secured to a free or distal end 64 of the handle support 60. Although any means can be used to secure the handle 62 to the handle support 60, as best shown in FIG. 2, the handle support 60 preferably includes a circular opening 66 having a pair of bayonet slots 68. The handle 62, in turn, includes a pair of bayonet tabs 70 which are positioned through the slot 68 so that the tabs 70 are positioned on the top surface of the handle support 60. Simultaneously an abutment ring 72 on the handle 62 abuts against a lower surface of the handle support 60.

With the bayonet being in tabs 70 positioned through the slot 68 in the above-described fashion, the handle 62 is rotated until the tabs 70 are substantially aligned with longitudinal axis of the handle support 60 and the rotation of the handle 62 is limited by a stop tab 74 (FIG. 2). The alignment of the tabs 70 with longitudinal axis of the handle support 60 insures a firm securement of the handle 62 to the handle support 60 along the axis of maximum stress i.e. to longitudinal axis of the handle support .

The lid 20, spout 22 and locking tabs 32 are all constructed of a material unreactive to water so that the cover assembly 10 can be used with water-borne paint. Preferably, the lid 20, spout 22 and locking tabs 32 are constructed of a synthetic plastic material, such as nylon. Other non-oxidizable materials which are unreactive to water can alternatively be used.

Similarly, the stirring assembly 50 is constructed of a material unreactive to water such as plastic. Likewise, the shaft 52 of the string assembly 50 is preferably constructed of stainless steel which will not rust or otherwise react to water.

From the foregoing, it can be seen that the cover assembly for the paint can of the present invention provides a cover assembly which can be used with water-borne paints without rusting or otherwise reacting with the paint. Furthermore, the cover assembly of the present invention can be inexpensively manufactured and yet enjoy long and durable use.

Having described my invention, however, many modifications thereto will become apparent to those skilled in the art to which it pertains without deviation from the spirit of the invention as defined by the scope of the appended claims

I claim:

1. A cover assembly for a paint can having an open top comprising:

a lid dimensioned to overlie the open top of the paint can, a spout attached to said lid to provide access to the contents of the paint can, a closure movable between a closed position in which said closure overlies and covers said spout and an open position in which said closure is spaced from said spout to thereby enable any contents of the paint can to be dispensed through said spout, means for selectively moving said closure between said open and said closed position, means for detachably locking said lid of the can, paint stirring means connected to said lid and extending downwardly into the paint can when said lid is secured to the can, a handle support extending outwardly from and generally coplanar with said lid, a handle, and means for securing said handle to said handle support.

wherein said handle is elongated and extends perpendicularly downwardly from said handle support, wherein said lid, said closure and said spout are constructed of a material which is not oxidizable by a water based paint.

2. The invention as defined in claim 1 wherein said lid and spout are constructed of plastic.

3. The invention as defined in claim 1 wherein the paint can includes a lip around its top and wherein said locking means comprises at least two locking tabs which extend under the paint can lip so that the paint can lip is entrapped between said tabs and an outer periphery of said lid, and wherein said locking tabs are constructed of a material not oxidizable by water based paint.

4. The invention as defined in claim 3 wherein said locking tabs are constructed of plastic.

5. The invention as defined in claim 1 wherein said closure is pivotally mounted at a midpoint to said lid, said closure having an opposite end which extends outwardly from said lid, and means for urging said closure to said closed position.

6. The invention as defined in claim 1 wherein said handle support and said lid are of a one piece construction.

7. The invention as defined in claim 6 wherein said means for securing said handle to said handle support comprises means for detachably securing said handle to said handle support.

8. The invention as defined in claim 7 wherein said detachable securing means comprises a bayonet coupling between said handle and said handle support.

9. The invention as defined in claim 8 wherein said bayonet coupling comprises a pair of bayonet tabs extending outwardly from an upper end of said handle, said bayonet tabs being received through openings in said handle support, and means for locking said bayonet tabs to said handle support so that said bayonet tabs are aligned with a longitudinal axis of said handle support.

10. The invention as defined in claim 2 wherein said plastic comprises nylon reinforced plastic.

11. A cover assembly for a paint can having an open top comprising:

a lid dimensioned to overlie the open top of the paint cans, a spout attached to said lid to provide access to the contents of the paint can, a closure movable between a closed position in which said closure overlies and covers said spout and an open position in which said closure is spaced from said spout to thereby enable any contents of the paint can to be dispensed through said spout, means for selectively moving said closure between said open and said closed position, means for detachably locking said lid of the can, paint stirring means connected to said lid and extending downwardly into the paint can when said lid is secured to the can, a handle support extending outwardly from and generally coplanar with said lid, a handle, and means for securing said handle to said handle support, wherein said handle support and said lid are of one piece construction, wherein said means for securing said handle to said handle support comprises means for detachably securing said handle to said handle support, wherein said detachable securing means comprises a bayonet coupling between said handle and said handle support, wherein said bayonet coupling comprises a pair of bayonet tabs extending outwardly from an upper end of said handle, said bayonet tabs being received through openings in said handle support, and means for locking said bayonet tabs to said hand support so that said bayonet tabs are aligned with a longitudinal axis of said handle support.

wherein said lid, said closure and said spout are constructed of a material which is not oxidizable by a water based paint.

* * * * *

UNITED STATES PATENT AND TRADEMARK OFFICE

CERTIFICATE OF CORRECTION

PATENT NO. : 5,368,389

DATED : November 29, 1994

INVENTOR(S) : John T. Dedoes

It is certified that error appears in the above-indentified patent and that said Letters Patent is hereby corrected as shown below:

Column 1, line 11 after "can" insert --.--.

Column 1, line 16 after "stir" insert --,--.

Column 1, line 21 after "stir" insert --,--. (1st occurrence).

Column 1, line 23 after "racks" insert --,--.

Column 1, line 67 after "paint" insert --.--.

Column 2, line 9 after"views" insert --,--.

Column 2, line 21 after "1" insert --,--.

Column 2, line 26 after "1" insert --,--.

Column 2, line 31 after "12" insert --.--.

Column 2, line 36 after "position" insert --,--.

Column 2, line 50 after "20" insert --,--.

Column 2, line 57 after "38" insert --.--.

Column 2, line 58 after "Furthermore" insert --,--.

Column 3, line 12 after "20" insert --.--.

Column 3, line 43 after "water" insert --,--.

UNITED STATES PATENT AND TRADEMARK OFFICE

CERTIFICATE OF CORRECTION

PATENT NO. : 5,368,389

DATED : November 29, 1994

INVENTOR(S) : John T. Dedoes

It is certified that error appears in the above-indentified patent and that said Letters Patent is hereby corrected as shown below:

Column 4, line 58 please delete "cans" and insert --can--.

Signed and Sealed this

Eighteenth Day of April, 1995

Bruce Lehman

*Attest:*

BRUCE LEHMAN

*Commissioner of Patents and Trademarks*

*Attesting Officer*